United States Patent [19]

Dietzel et al.

[11] 3,993,243

[45] Nov. 23, 1976

[54] CENTRIFUGE DRUM AND METHOD OF MAKING SUCH CENTRIFUGE DRUM

[75] Inventors: Walter Dietzel; Siegfried Matusch; Volkmar Hentschel, all of Braunschweig, Germany

[73] Assignee: Braunschweigische Maschinenbauanstalt, Braunschweig, Germany

[22] Filed: Mar. 25, 1975

[21] Appl. No.: 561,790

[30] Foreign Application Priority Data

Apr. 4, 1974 Germany ..... 2416305

[52] U.S. Cl. ..... 233/2; 233/27; 127/19

[51] Int. Cl.[2] ..... B04B 15/06

[58] Field of Search ..... 233/1 E, 2, 27; 127/19, 127/56; 210/380, 76

[56] References Cited

UNITED STATES PATENTS

| | | | |
|---|---|---|---|
| 1,946,500 | 2/1934 | Roberts | 210/76 |
| 3,334,751 | 8/1967 | Jaekel et al. | 210/380 |
| 3,640,467 | 2/1972 | Moller | 233/46 |

FOREIGN PATENTS OR APPLICATIONS

| | | | |
|---|---|---|---|
| 483,883 | 2/1970 | Switzerland | 233/27 |

*Primary Examiner*—George H. Krizmanich
*Attorney, Agent, or Firm*—W. G. Fasse; W. W. Roberts

[57] ABSTRACT

A drum for a centrifuge has a shell with a radially outer layer of plastic resin free of fibrous material, a radially inner layer of a fine mesh metal fabric embedded in a plastic resin material, and a plurality of intermediate layers of fibers, such as glass fibers embedded in plastic resin material, with the fibers of adjacent layers extending in different directions. The ends of the drum are thickened, and secured to flanges of end plates by screws having axially extending holes. Radially extending holes at the center of the shell are provided with tubular inserts. The holes axially extending through the screws also extend substantially radially relative to the drum.

13 Claims, 2 Drawing Figures

CENTRIFUGE DRUM AND METHOD OF MAKING SUCH CENTRIFUGE DRUM

BACKGROUND OF THE INVENTION

This invention is related to centrifuge drums, for example, centrifuge drums of the type employed for the production of sugar. The invention is particularly directed to a centrifuge drum of this type wherein the circumferential wall of the drum is formed of a plastic material. It will, of course, be understood, that the invention is not limited to drums for the production of sugar. In a typical centrifuge employed in the production of sugar, drums are provided having diameters of approximately 1250 mm. Such drums are rotated at speeds of, for example, 1450 revolutions per minute and the mass of sugar material being centrifuged may have a weight of, for example, 1000 kg. It is thus apparent that very strong centrifugal forces may arise in the operation of such centrifuges.

Steel drums may be provided which can readily absorb the forces in a centrifuging operation. Such steel drums, however, are very heavy, and represent an undesirably high fly wheel mass. As a consequence, it is desirable to employ a lighter and less expensive material for the drum of a sugar centrifue, for example, lighter plastic materials have been suggested for this purpose.

In the operation of a sugar centrifuge, a separating strainer or sieve is provided within the drum in contact with the inner radial surface of the drum. As the drum rotates, the strainer deforms and rubs against the wall of the drum due to centrifugal force thereon. When a plastic drum is provided, the strainer or sieve, in rubbing against the plastic wall, works itself into the plastic wall and progressively destroys the drum. As a consequence, the discharge of molasses from the drum in a sugar centrifuge operation may be rendered more difficult. As a result, it is apparent that the life of a plastic drum fabricated in accordance with known techniques is substantially reduced.

OBJECTS OF THE INVENTION

In view of the above, it is the aim of the invention to achieve the following objects singly or in combination:

to provide a centrifuge drum that overcomes the above disadvantages of prior art drums;

to provide a centrifuge drum of a plastic material, that is readily and econimically fabricated, and that is resistant to destructive forces resulting from contact with an internally arranged strainer; and to provide a centrifuge drum of laminated plastic material, wherein means are provided for inhibiting deterioration of the drum due to entry of liquids or moisture into the layers of the drum, and to assure good drainage during a prolonged life.

SUMMARY OF THE INVENTION

In accordance with the invention the above objects are achieved by forming a centrifuge of laminated material with the radially inner layer of the drum being formed of a plastic material, such as a plastic resin, in which is embedded a fine mesh fabric. The fabric is preferably a metal fabric. This inner layer is adapted to contact the strainer conventionally provided within a sugar centrifuge drum, and to withstand the rubbing contact with the strainer, so that the lamination layers radially outwardly of this inner layer are not deteriorated by contact with the strainer.

In addition, the inner layer prevents liquids and moisture from entry into the outer layers of the drum shell, and the consequent deterioration thereof.

A plurality of layers of fiber impregnated plastic material are provided surrounding the inner layer. The fibers in these layers, which are preferably glass fibers, are embedded in the material of the respective layers, and the fibers of adjacent layers may extend in different directions. For example, the fibers or fiber bundles may extend alternately in the circumferential and axial directions. Alternatively, the fibers may extend diagonally, i.e. so that they form spirals formed in opposite directions in adjacent layers. This structure is light weight and easy to fabricate, and resists the centrifugal forces and bending forces to which the drum is subjected.

The drum in accordance with the invention, may be provided with a radially outer wall of plastic material, in which no fibers are provided. The absence of fibers in this layer inhibits the introduction of moisture and liquids into the intermediate layers of the drum.

The plastic material of the drum is preferbly a resin, such as an epoxy resin, and the different layers of the drum are preferably bonded together to form a unitary structure, thereby increasing the strength of the drum, as well as increasing its resistance to deterioration.

The drum is provided with metal end plates having flanges which extend externally of the drum shell in radial contact therewith.

The ends of the drum shell may be reinforced by thickening at the exterior surface, whereby it is preferable that the interior of the drum has a constant diameter. Fastening means, such as screws, extend radially through the flanges and the thickened end portions of the drum shell, such as screws. It is preferred that the screws be inserted into the structure from within the drum, whereby loosening of the screws during a centrifuge operation is minimized. In order to provide discharge passages for material, such as molasses, centrifuged in the drum, the screws are provided with axially extending holes. Since the shanks of the screws surrounding the holes therethrough extend through the drum shell, these shanks prevent the entry of liquids or moisture into the lamination layers of the drum, and thereby inhibit the deterioration of the drum shell.

Additionally radially extending holes may be provided in the drum shell for the discharge of liquids. These holes, which may be located intermediate the ends of the drum shell, are lined with tubular rivets, in order to inhibit the ingress of liquids or moisture into the lamination layers, in the same manner that the shanks of the screws inhibit such ingress of liquids or moisture.

The centrifuge drum in accordance with the invention is hence economically manufactured, and the rubbing action of the internal strainer is prevented from damaging the laminated fiber layers by the provision of the plastic impregnated fabric layer. Consequently, the life of the structure is substantially increased, and the centrifuge drum in accordance with the invention can be employed to reliable centrifuge materials, such as sugar, for an extended period of time without replacement or repair.

BRIEF FIGURE DESCRIPTION

In order that the invention will be more clearly understood, it will now be described, by way of example, with reference to the accompanying drawings, wherein:

FIG. 1 is a cross sectional view of one half of a drum of a centrifuge, for example, a sugar centrifuge, incorporating the present invention, and FIG. 2 is an enlarged cross sectional view of a portion of the wall of the drum of FIG. 1.

DETAILED DESCRIPTION OF EXAMPLE EMBODIMENTS

Figure 1:
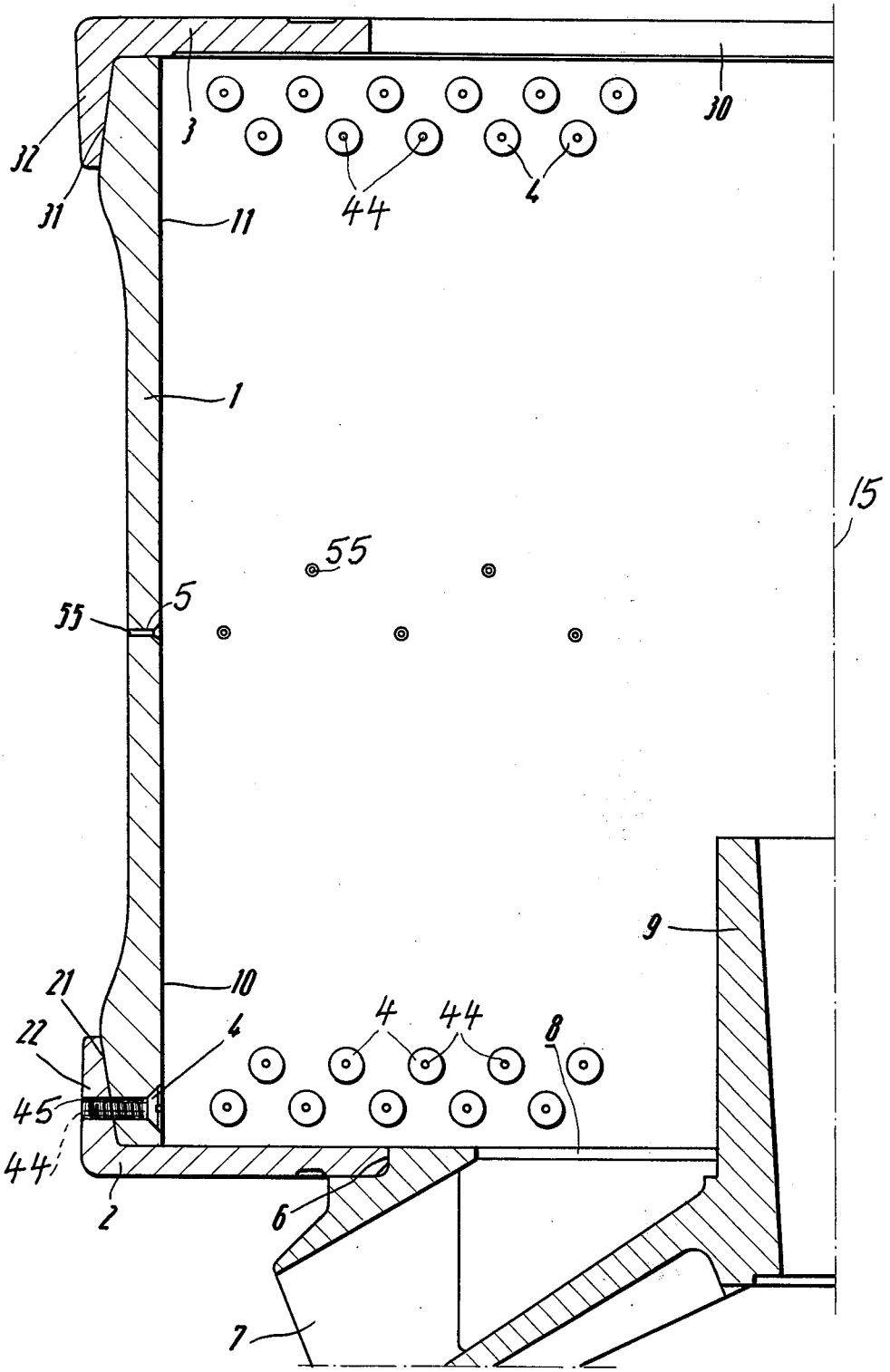

FIG. 1 illustrates a cross sectional view of the portion of a centrifuge drum to one side of the axis 15 thereof, the portions of the drum to the other side of the axis being substantially the same. The drum comprises a shell 1, which is preferably formed of a laminate material. The material of the drum will be discussed in greater detail with reference to FIG. 2. The drum shell 1 has a conventional cylindrical shape, and initially it is open at the top and bottom thereof. The internal diameter of the shell 1 is uniform throughout the length thereof. The ends of the shell 1 are reinforced by providing externally thickened end portions 10 and 11, these end portions are preferably chamfered, as indicated at 21 and 31 whereby the external diameter of the shell 1 increases from the ends of the shell 1 in the regions of the thickened end portions 10 and 11.

The bottom 2 and top 3 of the drum are circular metal plates having flanges 22 and 32 respectively extending outwardly over the reinforced ends 10 and 11 respectively of the shell 1, the flanges 22 and 32 being shaped to fit flush against the chamfered surfaces 21 and 31. The bottom 2 and top 3 of the drum are connected to the drum shell 1 by means of screws 4 which extend through the overlapping flange 22 and chamfered end portion 21 and through the overlapping flange 32 and chamfered end portion 31. It is preferred that the screws 4 be inserted from within the inside of the drum, whereby the heads of the screws face inwardly in the drum. As illustrated in FIG. 1, the screws 4 are provided throughout the circumference of the shell and the top and bottom flanges.

The screws 4 are provided with axially extending apertures 44, thereby providing passageways from the interior of the drum for the discharge of substances separated by rotation of the centrifuge drum, for example, molasses, when the drum is employed as a sugar centrifuge drum. It is to be particularly noted that the shanks 45 of the screws line the apertures 44, particularly in the region where the screws extend through the drum shell 1, in order to prevent the ingress of water or moisture into the laminated material of the wall of the shell 1.

Additional discharge apertures 5 may be provided at other locations in the drum shell 1, for example, in the center portion of the drum as illustrated in FIG. 1. The apertures 5 are lined with tubular rivets 55, in order to prevent the ingress of moisture into the material of the shell at the positions of the holes 5. In order to further inhibit the ingress of moisture into the drum wall by way of the screw apertures in the end portions 10 and 11, and in the apertures 5, and to avoid undesirable wetting of glass fibers of which the drum shell 1 is formed, the apertures in the wall of the shell 1 are not formed by drilling, but are produced by the insertion of removable cores, which are placed in position during the winding of the drum shell, and thereafter removed.

As illustrated in FIG. 1, the drum is provided with an axial drum boss 9 on a support member 8, the support member 8 being held by suitable conventional means, such as screws or the like, at a central aperture 6 in the bottom tube. The support member 8 may be provided with a discharge aperture 7 extending, for example, downwardly and outwardly from the drum, for the discharge of materials from which the molasses has been centrifuged. The top 3 is provided with a filler opening 30.

Figure 2:
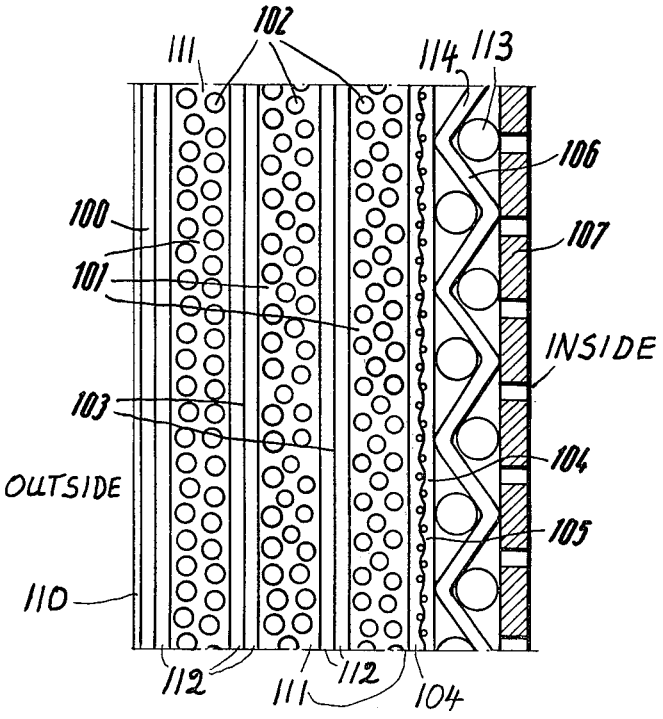

Referring now to FIG. 2, therein is illustrated a cross sectional view of a portion of the wall of the drum shell 1, in accordance with the invention. The left side of the figure corresponds to the external surface of the drum, and the right hand side of the figure corresponds to the internal surface of the drum. In the embodiment of the invention illustrated in FIG. 2, the wall of the drum shell comprises a laminated material made up of fibers and resin, and more particularly is comprised of glass fibers embedded in an epoxy resin. At the outside layer 100 of the drum, the resin is sufficiently enriched, so that no fibers are present at the surface of the drum or communicate with the atmosphere surrounding the drum. If desired, the external surface of the drum may be surrounded by a metal shell 110, for example, of steel, although this layer is not absolutely necessary in accordance with the invention.

The interior of the wall of the drum shell is comprised of a plurality of layers of fibers impregnated with an epoxy resin. For example, the interior of the wall may be comprised of a plurality of layers 111 formed of circumferentially extending fibers or fiber bundles 102, the fibers or fiber bundles 102 being indicated by small circles. The layers 111 are impregnated with the epoxy resin as indicated at 101. In addition, layers 112 between the layers 111 and, if desired, outside of the outermost layer 111 may be formed of axially extending fibers or fiber bundles 103 also impregnated with an epoxy resin. The wall of the shell may also be provided with diagonal intersecting fibers or fiber bundles, if desired.

A fine-grained stratum or layer 104 is provided at the interior of the radially innermost layer 111 or 112, the layer 104 being provided with a fabric insert 105. The layer 104 is comprised of a resin, more particularly an epoxy resin which may include a suitable silicate, this resin being firmly bonded to the resin 101 impregnating the remainder of the wall of the shell, for example, by fusion.

The fabric 105 embedded within the resin layer 104 has an especially close mesh, and is rather thin. This fabric is preferably formed of a metal, and may, for example, be a stainless steel fabric.

The fine, thin layer 104 forming the internal surface of the wall of the drum forms a protective inner skin for the drum in order to prevent a wide mesh backing strainer 106 within the drum from rubbing into the resin 101 and the fibers 102 of the drum during operation thereof. The wide mesh backing strainer 106 may be formed, for example, of circumferentially extending wires 113 intermeshed with axially extending wires 114. In addition, the fine grained layer 104 prevents moisture from seeping into the outer resin fiber wall, and thereby prevents the loosening of the bond between the resin 101 and the fibers 102 and 103 and the resultant bursting of the drum.

As illustrated in FIG. 2, a top strainer 107, for example, of brass or steel, may cover the backing strainer 106 at the interior of the drum. The backing strainer and/or the top strainer may be used separately or in combination. For the latter purpose they may form an integral structure.

In the arrangement of the invention, as above described, by providing the drum shell with layers of fibers or fiber bundles, which extend in different directions, to cross each other either in axial and circumferential directions or in diagonal winding directions, the drum shell can withstand forces on the drum in a lengthwise direction, as well as bending moments, in the most advantageous manner. The reinforced ends of the drum shell also aid in the strengthening of the structure, whereby bending moments on the drum shell are transferred by way of the screws 4 to the top and bottom plates. The holes extending through the screws joining the drum shell to the top and bottom plates provide, in a simplified manner, passageways for the discharge of materials from the drum, while protecting the laminate from ingress of water and moisture.

The fine grained layer 104 protects the glass fibers and plastic resin of the wall of the drum shell against rubbing forces exerted by the sieve structure within the drum. This is very important, since contact between the known internal sieve structure and the resin impregnating glass may otherwise result in the deterioration of the wall of the shell. In addition, the layer 104 protects the resin impregnated glass layers from moisture, which could also result in the deterioration of the wall of the shell, for example, by breaking-up of the bond between the resin and the glass fibers.

In addition, the centrifuge drum in accordance with the invention is simple and economical to manufacture, and its life is greatly extended. These advantages are obtained while insuring that the outflow of liquids from the certrifuge is satisfactory throughout its life, thereby reducing the costs of sugar production by the use of a drum in accordance with the invention.

Further, the woven fine mesh layer 104 reinforces the drum wall on the inside of the drum with respect to internal surface pressures in the drum resulting from dimensional variations of the sieve structure due to temperature softening, moisture and the like, since the fine meshed inner structure of the intermediate layer 104 prevents the relative coarse meshed sieve structure from impressing its projections onto the outer wall portion of the drum structure.

Although the invention has been described with reference to specific example embodiments, it is to be understood, that it is intended to cover all modifications and equivalents within the scope of the appended claims.

What is claimed is:

1. In a centrifuge drum having a radially outer wall for supporting an internal strainer on its radially inner surface and a pair of end walls affixed to said outer wall, the improvement wherein said radially outer wall comprises a first layer of a plurality of cross-wise oriented fibers, a second layer radially inwardly of said first layer forming said radially inner surface of said radially outer wall and comprising a thin fine-meshed stainless steel fabric, and a plastic resin in which said first and second layers are embedded, said end walls having axially extending upper flanges to which said radially outer wall is affixed.

2. The drum of claim 1, wherein said fibers of the first layer are glass fibers, wherein the plastic resin is an epoxy resin.

3. The drum of claim 1, wherein said fibers are glass fibers extending in axial and circumferential directions with respect to said drum.

4. The drum of claim 1 wherein said fibers are glass fibers extending helically relative to said drum.

5. The drum claim 1, wherein the axial center portion of said radially outer wall has a uniform diameter, and said radially outer wall at its ends is thicker than the center thereof to form thickened end portions.

6. The drum of claim 5, wherein said flanges of said end walls extend externally over the ends of said radially outer wall to fit tightly over the thickened end portions, and comprising fastening means extending radially through said flanges and the adjacent thickened end portions of said drum.

7. The drum of claim 6, wherein said fastening means comprises screws, said screws having axially extending holes, whereby the holes in said screws form discharge ports for material centrifuged in said drum.

8. The drum of claim 1, comprising a plurality of holes extending radially through said drum, and tubular sealing members inserted in said holes, whereby liquids and moisture are inhibited from ingress into said radially outer wall.

9. The drum of claim 8, wherein said tubular members comprise rivets having holes extending axially therethrough.

10. The drum of claim 8, wherein said tubular members comprise screws having holes extending axially therethrough.

11. The drum of claim 1, further comprising a radially outer layer of plastic material free of fibrous material on said radially outer wall.

12. The drum of claim 1, wherein said radially outer wall comprises a plurality of holes extending fully through the radially outer wall, said holes being initially formed by inserting a like plurality of cores into the radially outer wall as the latter is being formed and then removing these cores after the radially outer wall has hardened.

13. A drum for a centrifuge comprising a radially outer layer of a plastic resin free of fibrous material, a radially inner layer of a fine mesh stainless steel screen embedded in a plastic resin, and a plurality of radially intermediate layers each comprising fibers embedded in a plastic resin material, the fibers in adjacent layers extending in different directions, the plastic resin material of the layers of said drum shell being bonded together.

* * * * *